US008012043B2

(12) United States Patent
Emberger et al.

(10) Patent No.: US 8,012,043 B2
(45) Date of Patent: Sep. 6, 2011

(54) GRIP TAPE AND GRIP FOR BALL GAME RACKET

(75) Inventors: Manfred Emberger, Lochau (AT); Stefan Mohr, Wolfurt (AT); Claus Müller, Feldkirch (AT); Klaus Rambach, Peiting (DE); Gert Rhomberg, Dornbirn (DE)

(73) Assignee: Head Technology GmbH, Kennelbach (AT)

( * ) Notice: Subject to any disclaimer, the term of this patent is extended or adjusted under 35 U.S.C. 154(b) by 874 days.

(21) Appl. No.: 11/701,437

(22) Filed: Feb. 2, 2007

(65) Prior Publication Data

US 2008/0015062 A1 Jan. 17, 2008

(30) Foreign Application Priority Data

Feb. 2, 2006 (DE) ..... 10 2006 004 860
Feb. 2, 2006 (DE) ..... 10 2006 004 862

(51) Int. Cl.
*A63B 49/08* (2006.01)

(52) U.S. Cl. ..... 473/349

(58) Field of Classification Search ..... 473/549, 473/551, 538, 300, 301, 463; D21/725, 729
See application file for complete search history.

(56) References Cited

U.S. PATENT DOCUMENTS

| | | | | | |
|---|---|---|---|---|---|
| 259,448 | A | * | 6/1882 | Woodhouse | 473/551 |
| 1,539,029 | A | | 5/1925 | Surridge | |
| 4,613,537 | A | * | 9/1986 | Krupper | 428/192 |
| 4,974,846 | A | | 12/1990 | Fenton | |
| 5,082,266 | A | | 1/1992 | Lo | |
| 5,316,316 | A | * | 5/1994 | Lai | 473/538 |
| 5,492,324 | A | | 2/1996 | Hagey | |
| 5,671,926 | A | | 9/1997 | Hagey | |
| 5,695,418 | A | | 12/1997 | Huang | |
| 6,036,607 | A | * | 3/2000 | Finegan | 473/206 |
| 6,149,538 | A | * | 11/2000 | Tiura | 473/550 |
| 6,159,115 | A | * | 12/2000 | Hsu | 473/549 |
| 6,558,270 | B2 | * | 5/2003 | Kwitek | 473/301 |
| 6,857,971 | B2 | * | 2/2005 | Huang | 473/300 |
| 7,008,687 | B2 | * | 3/2006 | Wang | 428/192 |
| 7,232,378 | B2 | * | 6/2007 | Jaw | 473/300 |
| 2002/0082109 | A1 | * | 6/2002 | Wang | 473/300 |
| 2003/0100389 | A1 | * | 5/2003 | Severa et al. | 473/549 |
| 2003/0157991 | A1 | * | 8/2003 | Huang | 473/300 |
| 2003/0195065 | A1 | * | 10/2003 | Davis | 473/549 |
| 2003/0228930 | A1 | * | 12/2003 | Huang | 473/301 |
| 2004/0043827 | A1 | * | 3/2004 | Lamkin et al. | 473/300 |
| 2004/0259662 | A1 | * | 12/2004 | Huang | 473/301 |
| 2006/0116215 | A1 | * | 6/2006 | Jaw | 473/300 |
| 2007/0015599 | A1 | * | 1/2007 | Yang et al. | 473/300 |
| 2008/0172839 | A1 | * | 7/2008 | Wang | 16/421 |
| 2009/0258721 | A1 | * | 10/2009 | Huang | 473/300 |
| 2009/0260189 | A1 | * | 10/2009 | Jaw | 16/421 |

FOREIGN PATENT DOCUMENTS

CA 2079370 5/1996

(Continued)

OTHER PUBLICATIONS

Search Report in EP 07002333.8, mailed May 15, 2007.

*Primary Examiner* — Raleigh W. Chiu
(74) *Attorney, Agent, or Firm* — Finnegan, Henderson, Farabow, Garrett & Dunner, LLP

(57) ABSTRACT

The present invention relates to a grip tape for ball game rackets having a conical or trapezoidal base shape in the longitudinal direction or a length and a width, wherein the width varies at least along an essential portion of the length. The present invention also relates to a replacement grip tape including the features of a grip tape of the invention, and a process for producing a grip tape of the invention. Moreover, the present invention also relates to a grip for a ball game racket including a portion facing the head region of the ball game racket and having a first cross-section and a portion facing the end of the ball game racket and having a widening cross-section for holding the grip, as well as the combination of grip and grip tape.

20 Claims, 6 Drawing Sheets

FOREIGN PATENT DOCUMENTS

| | | | | |
|---|---|---|---|---|
| DE | 80 06 475 | | | 7/1980 |
| DE | 29 28 995 | A1 | | 4/1981 |
| DE | 33 12 927 | A1 | | 10/1984 |
| DE | 38 10 778 | A1 | | 10/1989 |
| DE | 3810778 | A1 | * | 10/1989 |
| DE | 90 02 204 | | | 8/1990 |
| DE | 90 03 995 | | | 10/1990 |
| DE | 196 41 464 | A1 | | 4/1998 |
| DE | 20 2004 009 870 | U1 | | 10/2004 |
| DE | 103 08 532 | B3 | | 10/2004 |
| EP | 1 060 767 | A2 | | 12/2000 |
| FR | 2813535 | A1 | | 3/2002 |
| GB | 600845 | | | 4/1948 |
| WO | WO 91/11223 | | | 8/1991 |
| WO | WO 01/97923 | A1 | | 12/2001 |
| WO | WO 03006113 | A1 | * | 1/2003 |

* cited by examiner

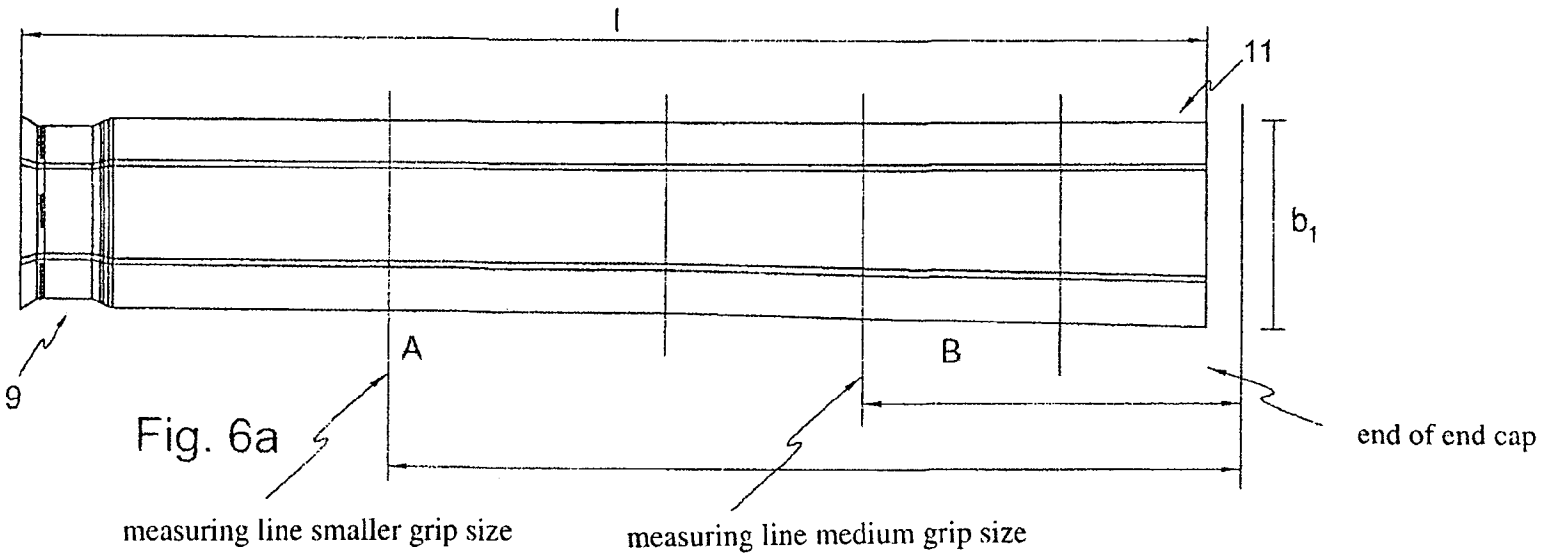
Fig. 6a
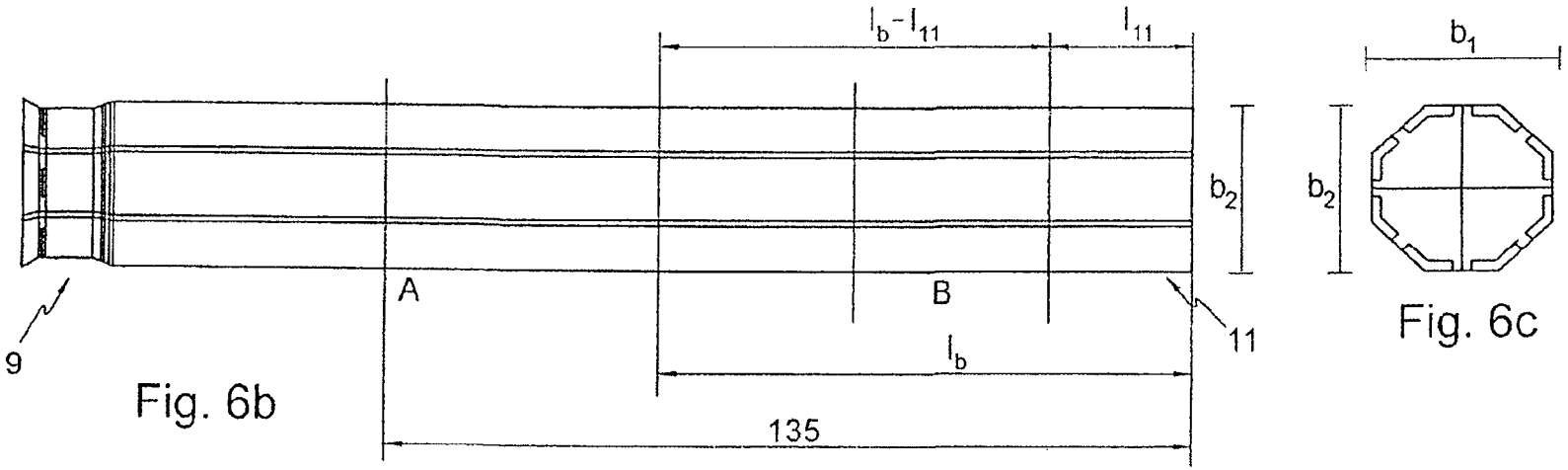
Fig. 6b
Fig. 6c

GRIP TAPE AND GRIP FOR BALL GAME RACKET

BACKGROUND OF THE INVENTION

1. Field of the Invention

The present invention relates to a grip tape and a replacement grip tape for a ball game racket, in particular tennis, squash, raquetball, badminton or paddle tennis racket. According to a further aspect of the present invention, it relates to a process for producing grip tapes of this kind. Moreover, the invention relates to a grip for ball game rackets of this kind, in particular in combination with a grip tape according to the invention, a ball game racket comprising a grip of this kind, and a process for producing a grip or racket of this kind.

Ball game rackets of the above-mentioned type comprise a frame having a head region for receiving a stringing and a hand grip or grip portion. Rackets of this kind can further comprise a heart region or fork being arranged between the head region and the grip portion.

The hand grip or grip portion of a ball game racket is particularly important since it is the link between racket and player. The hand grip or grip portion in particular serves the purpose of allowing the player to safely grip and guide the racket in different playing situations. The grip or grip portion thus serves for transmitting forces from the player to the racket. The other way round, the forces or shocks or vibrations occurring at the racket during the game, i.e. when contacting the ball, are transmitted to the player through the hand grip or grip portion.

The configuration of the hand grip or grip portion influences both the grip feel and guidance, i.e. the handling of the racket in different playing or gripping positions and the stress occurring at the player's palms being in direct or indirect contact with the grip and also the introduction of playing forces or shocks or vibrations into the hand or arm of the player and thus also the player's gripping and playing comfort.

Grip tapes are normally wrapped around the grip of a ball game racket in order to allow the player to handle the racket in the best possible manner. Different criteria such as, e.g., tack, moisture dissipation and cushioning effect are important in this regard.

2. Description of Related Art

A conventional replacement grip tape is described, e.g., in U.S. Pat. No. 5,695,418. A grip tape of this kind comprises an elongate, rectangular base shape and is wrapped spirally around the grip so that the edges thereof overlap. In the overlapping regions, raised regions are formed by the two layers of grip tape so that a structured grip surface is obtained. The thus created circumferential convexity or curvature should, on the one hand, increase the grip feel of the tape but can, on the other hand, also be uncomfortable for the player's hand and cause, e.g., blisters.

DE-A-38 10 778 suggests a grip tape for sport rackets which is chamfered along one or both edges so that the convexities formed when wrapping the hand grip are reduced or even prevented. However, avoiding such convexities is accompanied by a reduction in the grip feel. Further grip tapes that are chamfered along one or both end portions are known from DE 90 03 995 U1, WO-A-91/11223 and FR-A-2 813 535.

Furthermore, also different embodiments of hand grips or grip portions of ball game rackets are known, in particular also ergonomically formed grips and other symmetrical or asymmetrical grip shapes. Corresponding examples are shown in GB-A-600 845, DE-A-196 41 464, DE 20 2004 009 870 U1, DE-A-33 12 927, DE-A-29 28 995, DE-U-80 06 475, DE-U-90 02 204; CA-B-2079370, U.S. Pat. No. 5,671,926, DE-A-196 41 464, WO-A-01/97923 and U.S. Pat. No. 1,539, 029.

These known grips are not satisfactory in view of their grip feel, their suitability for gripping different gripping positions in different playing situations, in view of the force transmission and in particular in view of the forces, shocks or vibrations transmitted to the player, their fixing requirements, their relatively involved and thus expensive production and/or their high weight.

SUMMARY OF THE INVENTION

It is an object of the present invention to provide an improved grip tape and an improved replacement grip tape which overcome the disadvantages of the prior art. In particular, it is an object of the present invention to provide an improved grip tape and replacement grip tape which have, in particular, an improved tack and an improved grip feel and allow a more comfortable gripping of the racket by the player as compared to known grip tapes. Alternatively or additionally, it is an object of the invention to provide such an improved grip tape which can be produced efficiently and in a cost-saving manner.

Moreover, it is an object of the present invention to provide a grip for ball game rackets which overcomes the disadvantages of the prior art. It is a further object of the present invention to provide an improved grip in combination with an improved grip tape, wherein the advantages of the grip design and the advantages of the grip tape design are maintained or complement each other synergistically.

This/these object(s) is/are achieved by the features of the independent claims. The dependent claims relate to preferred embodiments of the present invention.

The invention starts out from the basic idea to configure the grip tape so as to have a conical or trapezoidal base shape in the longitudinal direction. Alternatively or additionally, a grip tape according to the invention has a length and a width, wherein the width varies along an essential portion of the length, preferably along at least approximately 50%, particularly preferably at least approximately 75% of its length.

Preferably, the grip tape according to the invention has at least a maximum width and at least a minimum width. The grip tape has a maximum width preferably close to the ends of the grip tape, approximately at half the length of the grip tape and/or at one third of the length of the grip tape.

The grip tape preferably has a first end and a second end and a length, wherein the grip tape has a first width close to its first end and a second width close to its second end. Used in this way, close means that the corresponding width is not spaced by more than approximately 10 to 20% of the overall length of the grip tape from the corresponding end in the longitudinal direction. To this end, the first width is preferably smaller than the second width. The increase in the width between the first end and the second end of the grip tape from the first width to the second width is preferably continuous but can also be discontinuous. According to preferred embodiments of the invention, the change in the width is linear, progressive and/or degressive. Preferably, the increase in the width is linear. In a preferred embodiment of the grip tape, it extends along a longitudinal axis, wherein the ends of the grip tape extend preferably approximately perpendicular with respect to the longitudinal axis. In a further embodiment of the grip tape, at least one of these end surfaces is inclined at least partially by an angle relative to the longitudinal axis of the grip tape. In accordance with the invention, the long sides of the grip tape are inclined relative to one another essentially by an angle β or enclose an angle β which lies in the range of approximately 0.1° to approximately 3°, preferably in the range of approximately 0.25° to approximately 2°, and particularly preferably approximately 0.5° to 1.5° or approximately 0.8° to approximately 1.2°.

According to a preferred embodiment, the length of the grip tape ranges between 80 cm and approximately 150 cm, preferably between approximately 90 cm and approximately 130 cm and is particularly preferably approximately 110 cm.

The first width of the grip tape preferably ranges between approximately 5 mm and approximately 25 mm, preferably between approximately 10 mm and approximately 20 mm and is particularly preferably approximately 15 mm.

The second width of the grip tape preferably ranges between approximately 20 mm and approximately 45 mm, preferably between approximately 28 mm and approximately 38 mm and is particularly preferably approximately 33 mm to 36 mm.

According to a preferred embodiment, the grip tape is symmetrical with respect to its longitudinal axis.

Furthermore, the inclination of the sides of the grip tape, i.e. the angle enclosed by the two side edges of the grip tape, is selected such that the course of the longitudinal axis of the grip tape and thus the grip tape contour, which are obtained when the tape is wrapped in an overlapping manner around a grip, are adapted to the hand of the player, i.e. the course of the fingers of the player's hand. Preferably, the inclination is selected such that in case of a grip tape wrapped around the grip, e.g., the grip according to the invention, the alignment of the grip's longitudinal axis varies in a top view of the wrapped grip along the length of the grip. In particular, the structures obtained when wrapping the grip tape in an overlapping manner do not extend parallel with respect to each other but are inclined with respect to each other, wherein the inclination increases continuously the more tape is wrapped. Hence, contours that are arranged like a fan with respect to each other are obtained depending on the grip tape design and/or the cross-sectional geometry.

The imaginary elongations of the contour lines in a plane seem to meet in one point. This results in a structure that is close to the anatomical shape of the human hand. In particular the fingers of the human hand do not extend parallel with respect to each other but extend from the finger root to the finger tips towards each other. Thus, the structure obtained by wrapping the grip tape of the invention in an overlapping manner, in particular the structure of the contours formed by the cross-sectional profile of the grip tape, optimally adapts itself to the anatomy of the human hand. Thus, the racket grip of the invention can be gripped in particular more safely and comfortably, wherein in particular the formation of blisters and skin irritations is reduced. Moreover, the playability of the player is positively influenced and the playability behavior is improved, in particular when playing with the racket for a long time, which normally leads to symptoms of tiredness.

The grip design of the present invention starts out from the basic idea to provide a grip for a ball game racket comprising a first portion having a first, preferably constant cross-section and a second portion with widening cross-section. The widening portion has preferably a length that is sufficient for the player's hand to hold the racket. This length corresponds preferably at least to approximately the width of one hand.

A grip of this kind generally has an elongate shape and extends along a longitudinal axis that can lie on the longitudinal axis of the racket. In the following, the term cross-section is used for designating the cross-section extending perpendicular with respect to the longitudinal axis of the grip.

The cross-section in the first portion is preferably a constant, preferably approximately rectangular, particularly preferably an approximately octangular cross-section. Starting from the first cross-section in the first portion, the cross-section widens uniformly, preferably linearly in the second portion. According to a preferred embodiment, the cross-section widens linearly and/or radially or progressively and/or degressively.

The second portion of the grip of the invention preferably faces the player, i.e. is arranged at the end of the grip facing the player, whereas the first portion is arranged in the region of the grip facing the ball game racket or racket head.

The cross-section preferably enlarges uniformly so that each cross-sectional area along the second portion is an enlargement of the first cross-sectional area of the first portion. The second cross-sectional area preferably has a cross-sectional area that is enlarged relative to the first cross-sectional area by approximately 2% to approximately 20%, preferably approximately 5% to approximately 10%.

Preferably, the outer surface of the grip in the second portion is inclined with respect to the outer surface of the grip in the first portion at least partially by approximately 0.25° to approximately 5°, preferably by approximately 0.3° to approximately 3.5°, particularly preferably by approximately 0.4° to approximately 2°. According to embodiments of the invention, the cross-section widens linearly, progressively and/or degressively. Particularly preferably, the two portions differ from each other by approximately 0.5 to 2 grip sizes, preferably by approximately 1 grip size, measured approximately centrally with respect to their lengths. Subsequent grip sizes normally differ in view of their circumferences by approximately 3.14 mm. With respect to their diameters, subsequent grip sizes normally differ by approximately 1 mm. According to the invention, the ratios of the length of the portion A to the length of the portion B lie in the range of approximately 1:3 to 3:1, preferably approximately 1:2 to 2:1, more preferably approximately 1:1.5 to 1.5:1 and 1:1.2 to 1.2:1, most preferably approximately 1:1.

In accordance with a preferred embodiment, the cross-sectional profile of the grip of the invention is essentially octangular. According to a preferred embodiment of the invention, the grip is formed by the frame of a ball game racket preferably integrally. According to a further preferred embodiment of the invention, the grip is realized as a grip shell that can be attached to a ball game racket.

The present invention preferably relates to a grip for tennis, squash, raquetball, badminton or paddle tennis rackets.

Moreover, the present invention relates to a ball game racket, preferably a tennis, squash, raquetball, badminton or paddle tennis racket comprising a grip of this kind.

The grip of the invention is advantageous in that it can be handled in an improved manner by the player. In particular by configuring the rear grip portion in accordance with the invention, a ball game racket can be held more safely, with less force being required and more comfortably. Furthermore, the design of a grip for a ball game racket according to the invention allows a better introduction of forces or shocks through the hand and in particular the carpus into the player's body.

Furthermore, since the rear grip portion is wedge-shaped, a force component is caused when a player grips the grip which extends parallel to the longitudinal axis of the grip and is directed against the grip surface in the wedge-shaped region, and thus the grip can be held in a safe and simple manner.

Moreover, the safe holding of the ball game racket is achieved as compared to the known grips by using the advantages of a form-fit grip combined with a frictional engagement.

The advantages in view of the handling of the racket or grip of the present invention are particularly evident when changing the grip positions, for instance when playing forehand and backhand in tennis. The corresponding effects become more apparent when using two-handed grip techniques, e.g. a two-handed backhand in tennis, or also when changing between one-handed and two-handed grip techniques, e.g. when changing between a one-handed forehand and a two-handed backhand or the like. To this end, it is in particular possible to overcome the known disadvantages of conical or cylindrical grips. In particular, a grip according to the invention provides an improved handling and an optimum grip force or holding power across its entire length.

In connection with the grip of the present invention, the grip tape of the present invention is particularly advantageous, in particular since the combination of grip and grip tape leads to synergetic effects in view of grip safety and grip comfort. Thus, the playability of the player is positively influenced and the playability behavior is improved, in particular when playing with the racket for a long time, which normally leads to symptoms of tiredness.

BRIEF DESCRIPTION OF THE DRAWINGS

In the following, a grip of the invention, a grip tape of the invention and a combination of grip and grip tape of the invention are described on the basis of a preferred embodiment with reference to the drawings in which FIG. 4 is a preferred shape of the conical grip of the invention, wherein FIG. 4*a* shows a side view, FIG. 4*b* shows a cross-sectional view of the grip in a first region, and FIG. 4*c* shows a cross-sectional view of the grip in a second region, FIG. 6 shows a preferred embodiment of a grip of the invention, wherein FIG. 6*a* shows a side view of the grip of the invention, FIG. 6*b* shows a top view of the grip of the invention, and FIG. 6*c* shows a cross-sectional view of the grip of the invention.

DETAILED DESCRIPTION

Figure 1:
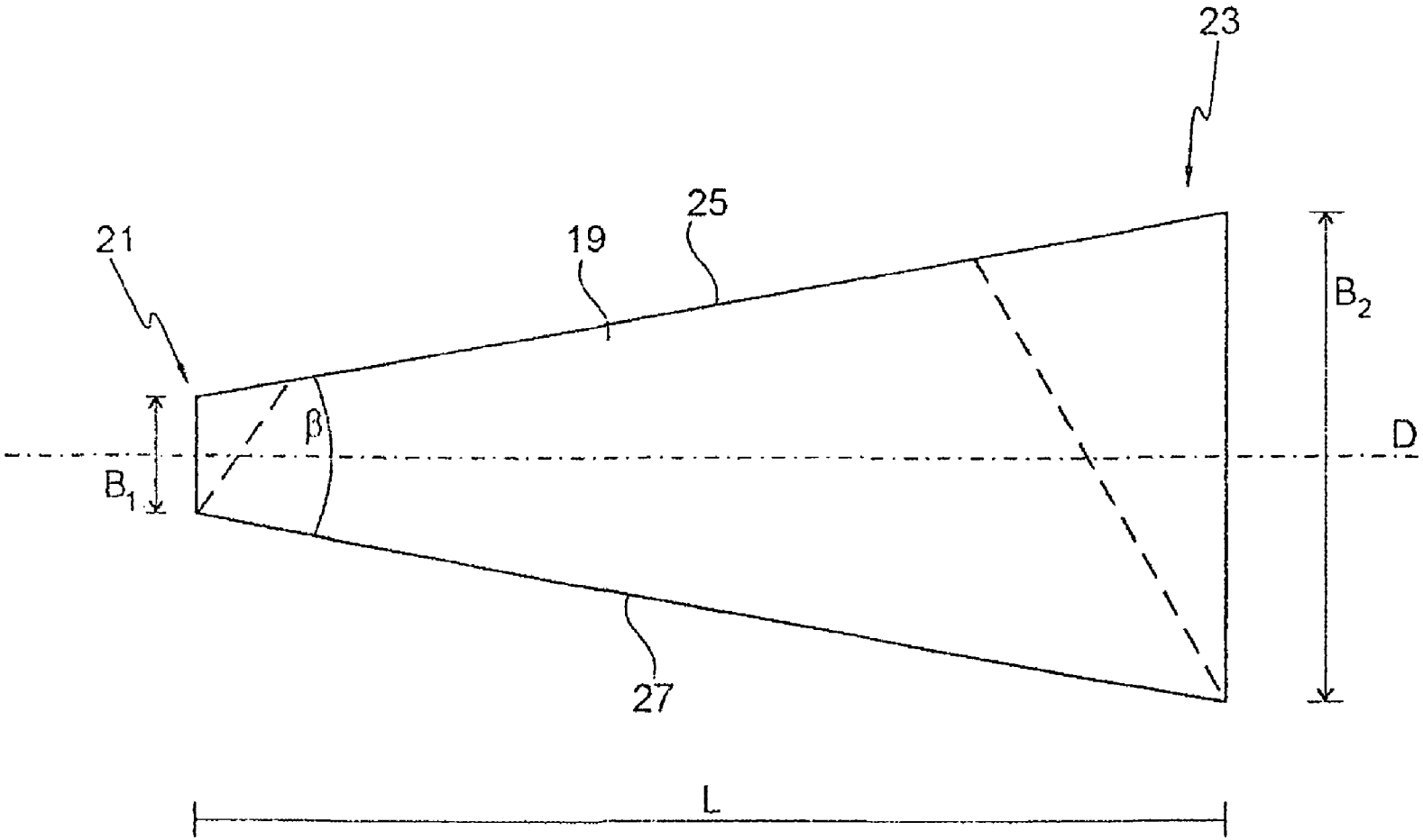
FIG. 1 is a schematic diagram of a top view of a grip tape of the invention.

FIG. 1 shows a grip tape 19 of the invention comprising a longitudinal axis D, a length L, a first end 21 having a first width $B_1$ and a second end 23 having a second width $B_2$.

The grip tape 19 preferably has a conical or trapezoidal base shape in the longitudinal direction, i.e. along the longitudinal axis D. The grip tape 19 has a length L and a width B. While in the embodiment of FIG. 1, the width B varies along the entire length L, according to the invention the width B can also vary only along an essential portion of the length L, for example at least 50% or at least 75%, and be constant, e.g., in the remaining portion.

The grip tape is preferably made of or comprises materials that are known in the prior art for making grip tapes, e.g. leather, artificial leather, plastic materials and the like. The design or structure of the grip tape of the invention moreover preferably corresponds to the structures or designs known in the prior art. In a cross-sectional view, the grip tape can have the structures known in the art. For example, it can be flat or curved, have flat, raised or sloping side regions and/or have structures influencing the grip feel, etc. Preferably, in a cross-sectional view the grip tape has a curved profile with flattened side edges. These side edges preferably have a width of approximately 1 to 3 mm. When wrapping the tape in an overlapping manner onto a grip, neighboring tape portions preferably overlap at least partially in the region of these flattened edges.

As shown in FIG. 1, the first width $B_1$ is smaller, preferably essentially smaller, and particularly preferably many times smaller than the second width $B_2$. As shown in FIG. 1, the grip tape 19 widens preferably continuously between the first end 21 and the second end 23 from the first width $B_1$ to the second width $B_2$. According to preferred embodiments of the invention, the grip tape 19 can widen linearly, progressively and degressively. Particularly preferably, the width widens uniformly between the first end 21 and the second end 23 from the first width to the second width. Preferably, the grip tape can have a constant width at least in a portion.

According to a preferred embodiment of the invention as shown in FIG. 1, the end sides of the grip tape extend essentially perpendicular with respect to the longitudinal axis D of the grip tape. In accordance with a further embodiment of the invention (not shown), at least one end, according to a further preferred embodiment both ends 21, 23 are chamfered relative to the longitudinal axis of the grip tape (shown in dashed lines in FIG. 1). Thus, the position of a maximum width of the grip tape can move along the longitudinal axis. Preferably, the grip tape has its maximum width approximately in the region of the end 23 or, if the end 23 is chamfered, approximately 5 to 10 cm away from the end 23.

Preferably, the length L of the grip tape ranges between approximately 80 cm and approximately 150 cm, preferably between approximately 90 cm and approximately 130 cm and particularly preferably it lies at approximately 110 cm. The first width $B_1$ of the grip tape preferably ranges between approximately 5 mm and approximately 25 mm, preferably between approximately 10 mm and approximately 20 mm and particularly preferably it is approximately 15 mm. The second width $B_2$ of the grip tape preferably ranges between approximately 20 mm and approximately 45 mm, preferably between approximately 28 mm and approximately 38 mm and particularly preferably it is approximately 33 mm to 36 mm.

All in all, the length and varying width of the grip tape should be adjusted such that the entire surface of the grip tape minus an overlap that is possibly formed during wrapping corresponds to approximately at least the surface of the grip, which is typically approximately 300 to 400 $cm^2$, because the grip tape has to wrap this surface.

In a preferred embodiment of the invention, the longitudinal sides 25, 27 of the grip tape 19 essentially enclose an angle β. The angle β lies in the range of approximately 0.1° to approximately 3°, preferably in the range of approximately 0.25° to approximately 2° and particularly preferably is approximately 0.8° to approximately 1.2°.

According to a further preferred embodiment of the invention, the grip tape is symmetrical with respect to the center line D.

Preferably, the inclination of the longitudinal sides 25, 27 of the grip tape is selected such that the contours obtained when wrapping the tape in an overlapping manner onto a grip are adapted to the anatomy of the human hand or the course of the fingers of a human hand so that the racket can be gripped particularly comfortably and safely. Particularly preferably, the inclination of the longitudinal sides 25, 27 of the grip tape or the angle β is selected such that the contours obtained when wrapping the tape in an overlapping manner onto a grip show an inclination that decreases from the grip end towards the grip portion facing the racket head. Preferably, the inclination varies so that the tape wrapped around a grip has an optimum contour. For example, a longitudinal sectional view of the above-described embodiment of a grip tape having flattened edges or side regions and a convex center portion shows in the wrapped state a contour of alternating convexities and flat regions, wherein at least the width of the convex portions decreases along the grip.

Figure 2:
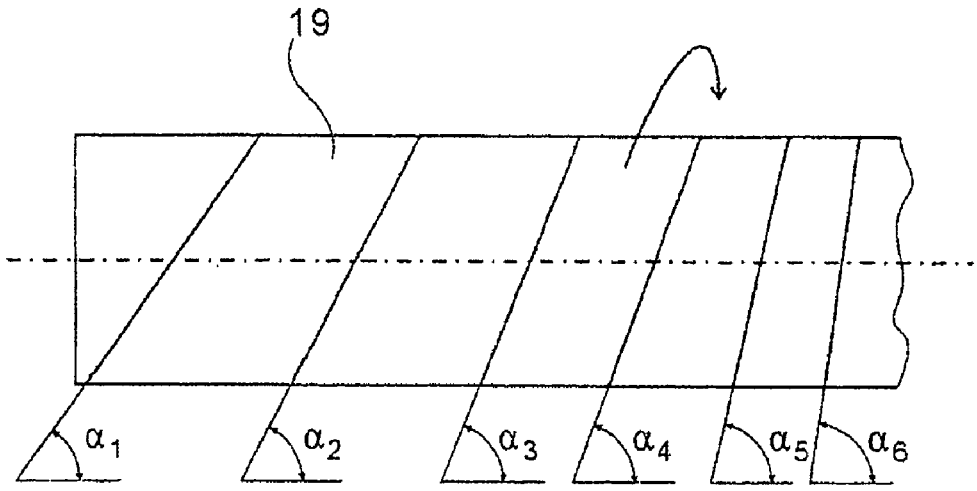
FIG. 2 is a schematic diagram of a grip tape of the invention in wrapped state on a conventional grip.

In the schematic diagram of FIG. 2 it is shown that in a top view of a grip around which a grip tape according to the invention is wrapped the contours extend towards each other and are thus optimally adapted to the contour or anatomy of the human hand and in particular the course of the fingers of the human hand. The player can thus grip the racket grip safely and comfortably. In other words, the inclination of the longitudinal axis of the grip tape increases in the wrapping direction in a top view. As shown in FIG. 2, in a top view the angle $\alpha_1$ between the longitudinal axis of the grip and the longitudinal axis of the grip tape increases with any winding starting from the grip end (on the left-hand side of the Figure) in the direction towards the head portion (towards the right-hand side of the Figure). The angles $\alpha_i$ preferably fulfill the equation $\alpha_{i+1}-\alpha_i=\beta$, wherein i is 1, 2, 3, 4, 5 etc. Thus, for example in FIG. 2 it is true that $\alpha_2-\alpha_1=\beta$. The wrapping direction is shown in FIG. 2 by an arrow. In case of a neat wrapping, β essentially corresponds to the angle β formed between the longitudinal sides 25, 27 of the grip tape, as described above.

According to a process for producing the grip tape of the invention, a web of raw material which possibly already has the desired cross-sectional contours is produced. The webs of raw material can preferably be separated into two grip tapes of the invention by a cutting operation or a separating operation. One grip tape is cut such from the web of raw material that the edge of cut formed at the web of raw material becomes a side of the next grip tape. Preferably, the cutting pattern is such that a maximum number of grip tapes can be cut from one web of raw material with minimum scrap. For example, a preferred web of raw material has an approximately rectangular base shape, wherein a cutting or separating operation along a cutting line being inclined relative to the sides of the base shape yields exactly two grip tapes of the invention. This leads to a simple and resource-saving production. The desired cross-sectional contours and/or flattened side regions can be made in a step before or after the separating operation.

The grip tape of the invention allows a safe gripping with reduced loading of the player. Thus, the racket can be handled optimally, it is easy on the resources of the player, and injuries such as blisters or a tennis elbow are avoided. The grip tapes of the invention can be handled well, their construction is simple so that the production costs are low, and they can be attached in a simple manner.

Figure 3:
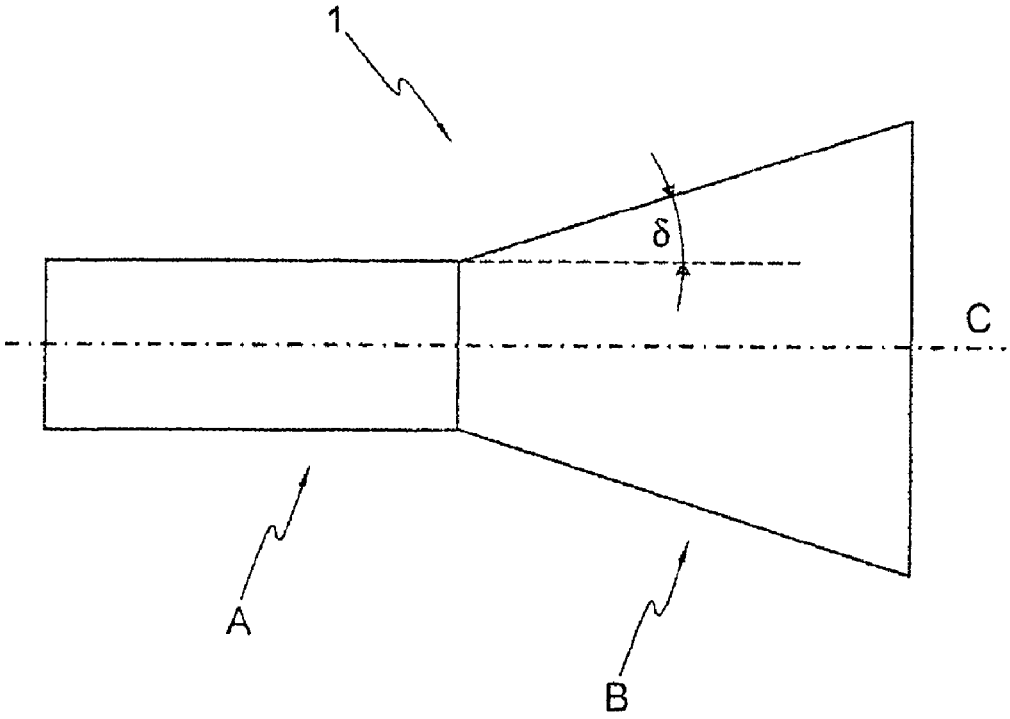
FIG. 3 is a schematic diagram of a side view of a conical grip of the invention.

FIG. 3 shows a schematic diagram of a grip 1 for holding a ball game racket, wherein the grip 1 has a first or front grip portion A and a second or rear grip portion B. The first grip portion A has a constant first cross-section and the second grip portion B has a varying cross-section. The cross-section of the grip portion B widens, starting from the cross-section of the grip portion A, preferably essentially continuously. This is achieved in that the grip portion B has an essentially conical shape, while the grip portion A has a cylindrical shape with octangular cross-section that remains essentially the same along its entire length. According to alternative embodiments of the invention, the portion B of the grip has a conically or pyramidally widening shape or a conical or pyramidal shape.

The grip of the invention extends essentially along a longitudinal axis C, wherein the outer surfaces of the first grip portion A are essentially parallel with respect to the longitudinal axis C. The outer surfaces of the grip portion B are inclined relative to the longitudinal axis C by an angle δ of approximately 0.25° to approximately 5°, preferably approximately 0.3° to approximately 3.5°, or approximately 0.4° to approximately 2°, particularly preferably approximately 0.8° to approximately 1.2°. According to a particular embodiment of the invention, the angle δ between the outer surface of the grip portion B and the longitudinal axis C is approximately 0.5°, preferably 0.75°, more preferably approximately 1°.

Figures 4, 4A, 4B, 4C:
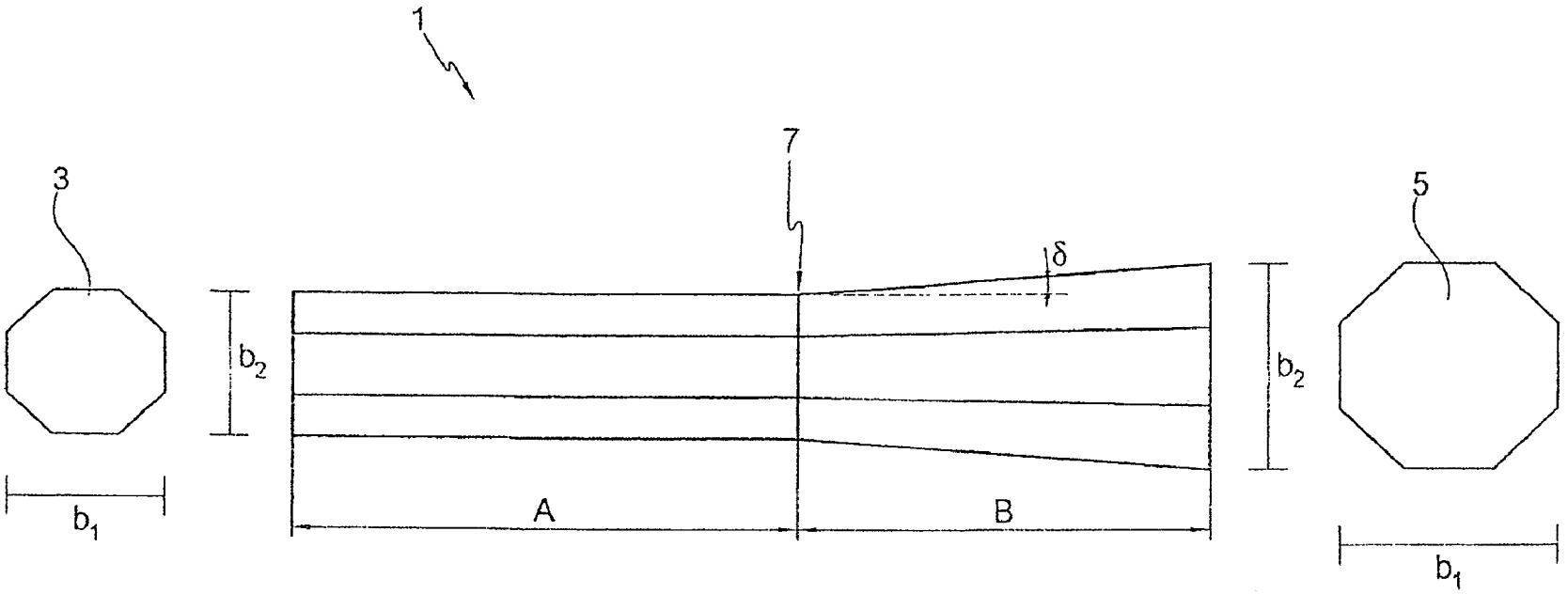

FIG. 4 shows a preferred embodiment of a grip of the invention having an essentially octangular cross-section, wherein FIG. 4*a* shows a side view of the grip of the invention, FIG. 4*b* a top view of the cross-section 3 in the first portion A of the grip of the invention, and FIG. 4*c* a top view of the maximum cross-section 5 in the portion B of the grip 1 of the invention.

As evident from FIG. 4, the portion A has a first cross-section 3 which is essentially constant along the length of the portion A. The portion B has a cross-section that varies along the length of the portion B. Preferably, portion A and portion B adjoin each other at a position 7. At this position 7, portion A and portion B have the same cross-section, which corresponds to the cross-section 3 of portion A. Starting from this cross-section 3, the cross-section of portion B widens up to a maximum cross-section as shown in FIG. 4*c* by cross-section 5. Preferably, the cross-section of the grip widens in the portion B starting from the first cross-section 3 up to the second cross-section 5 essentially linearly.

According to further preferred embodiments, the cross-section changes progressively or degressively. Also combinations of progressively, linearly and/or degressively widening diameters lead to preferred embodiments of the present invention. According to further preferred embodiments, the portions A and B can have transition cross-sections, at least in the outer regions of the grip, which lie as a rule outside the grip region that is gripped by the player.

Figure 5:
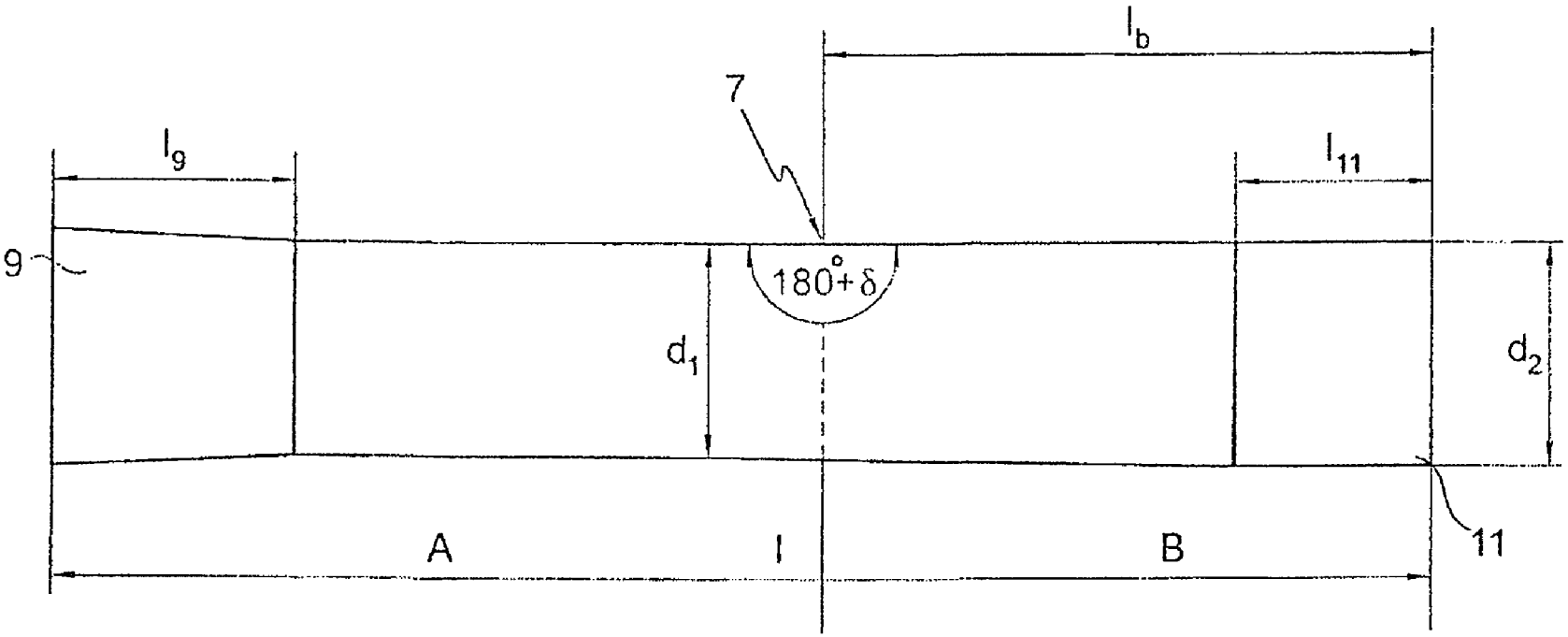
FIG. 5 shows a preferred embodiment of a grip of the invention.

FIGS. 5 and 6 show further preferred embodiments of a grip for a ball game racket according to the invention comprising a first portion A and a second portion B. The grip preferably has an overall length l of approximately 15 cm to approximately 25 cm, preferably approximately 17 cm to approximately 20 cm. According to particularly preferred embodiments, the grip has a length l of approximately 17.3 cm or approximately 19.5 cm. According to preferred embodiments of the invention, the ratio of the length of the portion B to the length of the portion A lies in the range of approximately 1:3 to 3:1, preferably approximately 1:2 to 2:1, more preferably approximately 1:1.5 to 1.5:1 or 1:1.2 to 1.2:1. Preferably, the length $l_b$ of the grip portion B lies in the range of 5 cm to 18 cm, preferably in the range of 6 cm to 12 cm. Particularly preferably, the length $l_b$ is approximately 7.6 cm to approximately 8.9 cm.

The thickness $d_1$ or the circumference of the first grip portion A lies preferably approximately in the normal ranges as selected by the desired grip size. In the region of the largest cross-section of the grip in portion B, preferably at the end of portion B, the thickness $d_2$ or the circumference increases relative to that of grip portion A by approximately 0.25% to approximately 3%, preferably by approximately 0.5% to 1.5%. Particularly preferably, portions A and B differ from each other, approximately centrally with respect to their lengths, by approximately 0.5 to 2 grip sizes, preferably by approximately 1 grip size. Subsequent grip sizes normally differ from each other with respect to their circumferences by approximately $\pi$ mm. In view of their diameters, subsequent grip sizes differ by approximately 1 mm. The common grip size table for Europe and the U.S.A. is shown below:

| Designation American | European | Circumference [mm] |
|---|---|---|
| 4⅛ | 1 | 104.8 |
| 4¼ | 2 | 107.9 |
| 4⅜ | 3 | 111.13 |
| 4½ | 4 | 114.3 |
| 4⅝ | 5 | 117.5 |

According to a further preferred embodiment of the invention, the grip comprises end portions 9, 11 arranged at the transition between grip portion A and the racket heart or the end of the grip portion B. The length $l_9$ of the portion 9 is preferably approximately 5 mm to 40 mm, particularly preferably approximately 10 mm to 30 mm. The length $l_{11}$ of the portion 11 is preferably approximately 10 mm to 40 mm, preferably approximately 20 mm to 30 mm. In these portions 9, 11, the grip has possibly a cross-sectional profile that differs from the cross-sectional profile of portions A and B. The end portions 9, 11 can be realized as a part of portions A and B and/or as additional grip portions.

In portion(s) 9 and/or 11, the grip can have a varying or constant cross-section. In FIG. 5, the portion 9 has a cross-section that widens towards the racket head, while the portion 11 has a constant cross-section. According to FIG. 6, the portion 11 has a constant cross-section, while the portion 9 has a varying cross-section with diminishing cross-section. The portions 9 and 11 preferably serve as a transition from grip portions A and B to the ends of the grip.

Preferably, the grip of the invention as shown, e.g., in FIGS. 4 and 6, has an essentially octangular cross-section having a first width $b_1$, and a second width $b_2$, wherein the width $b_2$ is preferably smaller than the width $b_1$. The widths $b_1$, and $b_2$ preferably vary in accordance with the widening of the cross-section. Preferably, the ratio of the widths $b_1$:$b_2$ is constant across the cross-sectional variation in portion B.

The designations "measuring line smaller grip size" and "measuring line medium grip size" exemplarily indicate preferred positions for measuring the respective grip size in the region A ("measuring line smaller grip size") and in the region B ("measuring line medium grip size"). Preferably, in the region B the grip size is measured approximately centrally with respect to its length. As shown in FIG. 6*a*, in the region B the grip size is more preferably measured approximately centrally with respect to the length $l_b$-$l_{11}$ of the widening cross-section, if the portion B comprises, e.g., a portion 11 having a constant cross-section, for example for receiving an end cap (not shown). The end of the end cap (not shown) is indicated in FIG. 6 by the line "end of end cap".

The grip of the invention is preferably formed integrally, i.e. as one piece with the racket. According to a further embodiment of the invention, the grip is formed as a one-piece or multi-piece grip shell for being attached to a ball game racket. To this end, the grip preferably comprises a fixing means (not shown) for being fixed to the ball game racket. Preferably, the grip is hollow, wherein the fixing means is formed by a hollow space that extends essentially through the grip.

The grip in the form of a grip shell preferably comprises polyurethane or is made of polyurethane.

Figure 7:
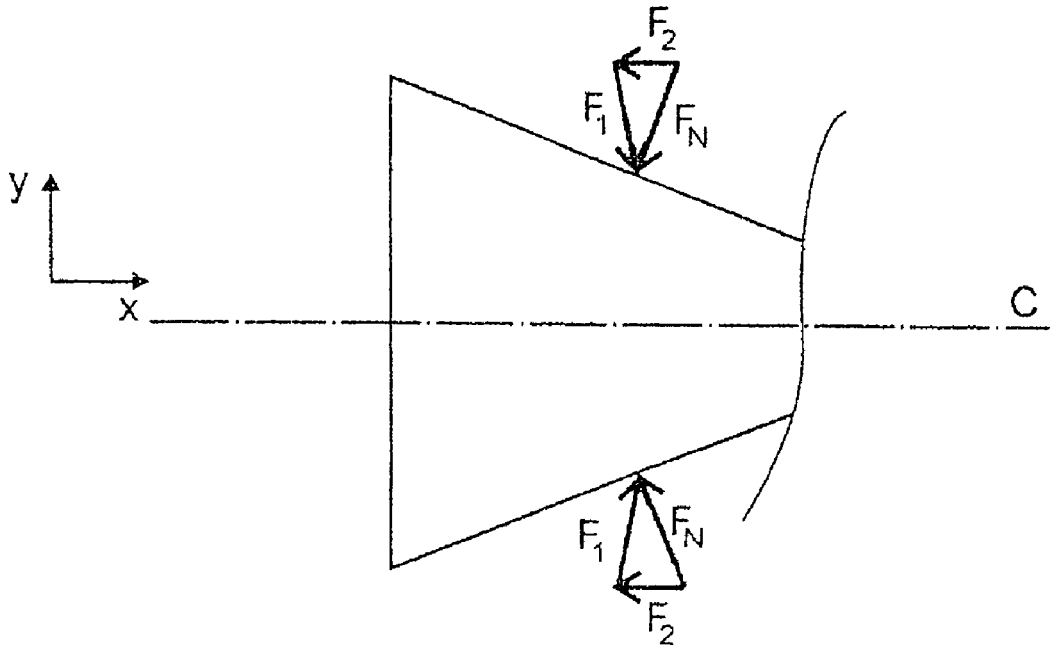
FIG. 7 is a schematic diagram of the forces occurring when gripping a grip of the invention.

FIG. 7 shows a schematic diagram of the forces occurring when the grip of the invention is gripped at portion B. The hand of the player applies a force $F_N$ which can be divided into a force component $F_1$ perpendicular to the longitudinal axis C of the grip and a force component $F_2$ parallel to the longitudinal axis C of the grip. In contrast thereto, when gripping a grip portion having a constant cross-section, only a force component perpendicular to the longitudinal axis of the grip is formed but no force component parallel to the longitudinal axis of the grip. While holding a grip having a constant cross-section is only possible due to forces in the longitudinal direction generated during the use of the racket and the coefficient of friction between the hand of the player and the surface of the grip and the force applied by the player perpendicular with respect to the surface of the grip, the grip design of the invention allows the formation of a force component $F_2$ extending essentially parallel to the longitudinal axis C of the grip. This force component is directed against the grip surface that is inclined relative to the widening cross-section of the grip and thus allows a safe holding of the grip because it counteracts a slipping-out of the racket through the hand of the player.

The grip design of the invention allows both the formation of a frictional engagement and also the formation of a form-fit engagement between the hand of the player and the grip, so that a particularly safe and firm gripping of the racket or the grip is possible with low force being required.

The provision of a portion A having a constant cross-section furthermore leads to an individually optimized gripping of the grip along the portion B or in the transition region between portion A and portion B. Furthermore, when portions A and B are realized in accordance with the invention, it is possible to guide a racket comprising a grip of the invention in a comfortable and safe manner in that the first hand, i.e. playing hand grips safely and comfortably essentially in the region B of the grip, as described above, and the second hand can grip the grip safely in portion A having an essentially constant cross-section, without leading to any disadvantages caused by a too small grip diameter that could be present, e.g., in a constantly conical grip.

Moreover, the grip of the present invention is advantageous in that not only an individually optimized gripping of the grip by the player is possible but also an optimum individual re-gripping, as often required during a ball game.

Furthermore, the realization of portion B with widening cross-section leads to an optimized introduction of forces and shocks into the human body.

Figure 8:
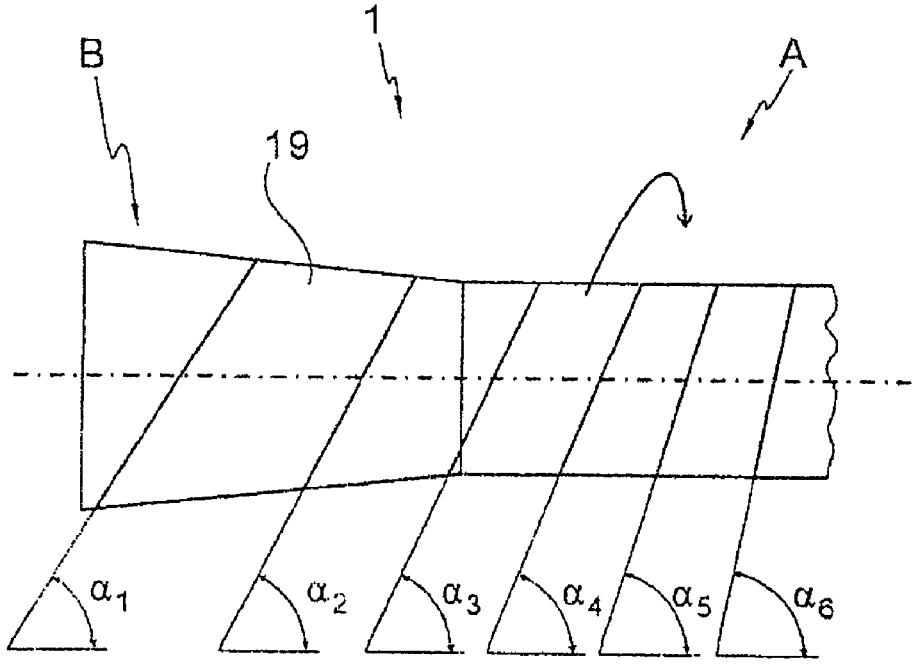
FIG. 8 is a schematic diagram of a grip tape of the invention in the wrapped state on a grip of the invention.

The particularly advantageous combination of the grip tape of the invention and the grip of the invention is shown in FIG. 8. Here, too, in a top view of a grip of the invention comprising a grip tape of the invention, the elongated contours extend towards each other and are thus optimally adapted to the contour or anatomy of the human hand and in particular the course of the fingers of the human hand. As shown in FIG. 8, in a top view the angle $\alpha_i$ between the longitudinal axis of the grip and the longitudinal axis of the grip tape increases with any winding starting from the grip end (on the left-hand side of the Figure) in the direction towards the head portion (towards the right-hand side of the Figure). The angles $\alpha_i$ essentially fulfill the equation $a_{i+1}-\alpha_i=\beta$, wherein i is 1, 2, 3, 4, 5 etc. In the embodiment of FIG. 8, the advantages of the grip of the invention and of the grip tape of the invention thus coincide synergistically.

The invention claimed is:

1. A grip tape for a grip of a ball game racket, the grip tape comprising:

a length of at least approximately 80 cm, such that the grip tape is sized and configured to substantially spirally cover the grip; and a predetermined width that varies along at least a substantial portion of the length.

2. The grip tape according to claim 1, further comprising a conical or trapezoidal base shape in a longitudinal direction of the grip tape.

3. The grip tape according to claim 1, wherein the width varies along at least 50% of the length of the grip tape.

4. The grip tape according to claim 2, wherein the grip tape has a first width close to a first end and a second width close to a second end, wherein the first width is smaller than the second width.

5. The grip tape according to claim 4, wherein the width increases substantially linearly between the first end and the second end.

6. The grip tape according to claim 2, wherein at least one end of the grip tape is chamfered relative to a longitudinal axis of the grip tape.

7. The grip tape according to claim 2, wherein a first width of the grip tape ranges between approximately 5 mm and approximately 25 mm, and a second width of the grip tape ranges between approximately 20 mm and approximately 45 mm.

8. The grip tape according to claim 2, wherein at least one side of the grip tape is inclined relative to a longitudinal axis of the grip tape by an angle.

9. The grip tape according to claim 8, wherein the angle is approximately 0.1° to approximately 3°.

10. The grip tape according to claim 2, wherein the grip tape is symmetrical with respect to a longitudinal axis of the grip tape.

11. The grip tape according to claim 2, wherein the shape of the grip tape is configured so that the inclination of a longitudinal axis of the grip tape increases in a wrapping direction when the grip tape is wrapped in an overlapping manner onto the grip.

12. The grip tape according to claim 2, wherein the grip tape comprises at least one of polyurethane, leather, artificial leather, a nonwoven made of natural fibers, and a nonwoven made of synthetic fibers.

13. The grip tape according to claim 2, wherein the grip tape is a replacement grip tape.

14. A ball game racket, comprising:

a frame forming a head region for realizing a striking region;

a grip including a first portion facing the head region of the ball game racket and having a first cross-section, and a second portion facing the end of the ball game racket and having a widening cross-section; and a grip tape wrapped on the grip, the grip tape including:

a length and a predetermined width, wherein the width varies along at least a substantial portion of the length so as to form a conical or trapezoidal base shape in a longitudinal direction of the grip tape.

15. The ball game racket according to claim 14, wherein the grip has a conically widening cross-section in the second portion and a substantially constant cross-section in the first portion.

16. The ball game racket according to claim 14, wherein the cross-section increases substantially linearly in the second portion.

17. The ball game racket according to claim 14, wherein an outer surface of the grip in the second portion is inclined relative to the outer surface of the grip in the first portion by approximately 0.25° to approximately 5°.

18. The ball game racket according to claim 14, wherein the length ratio of the first portion to the second portion is approximately 3:1 to 1:3.

19. A ball game racket, comprising:

a frame forming a head region for realizing a striking region;

a grip, including a first portion facing the head region of the ball game racket and having a first cross-section, and a second portion facing the end of the ball game racket and having a widening cross-section; and a grip tape wrapped on the grip, the grip tape including a length and a predetermined width, wherein the width varies along at least a substantial portion of the length.

20. The ball game racket according to claim 19, wherein the width varies along at least 50% of the length of the grip tape.

* * * * *